US006591451B2

(12) United States Patent
Gruber et al.

(10) Patent No.: US 6,591,451 B2
(45) Date of Patent: Jul. 15, 2003

(54) AUTOMOTIVE DOOR HINGE WITH REMOVABLE COMPONENT ADAPTED FOR STRUCTURAL REASSEMBLY

(75) Inventors: Rudolf Gruber, Uxbridge (CA); David Carswell, Aurora (CA); John J. Salmon, Bury St. Edmunds (GB)

(73) Assignee: Multimatic, Inc., Markham (CA)

( * ) Notice: Subject to any disclaimer, the term of this patent is extended or adjusted under 35 U.S.C. 154(b) by 0 days.

(21) Appl. No.: 10/147,462

(22) Filed: May 17, 2002

(65) Prior Publication Data

US 2002/0174518 A1 Nov. 28, 2002

(30) Foreign Application Priority Data

May 24, 2001 (CA) ..... 2348323

(51) Int. Cl.[7] ..... E05D 7/10

(52) U.S. Cl. ..... 16/262; 16/260; 16/265; 16/254; 16/381

(58) Field of Search ..... 16/262, 260, 264, 16/265, 270, 254, 273, 381, 386, 387; 296/202, 146.11, 146.12

(56) References Cited

U.S. PATENT DOCUMENTS 4,766,643 A * 8/1988 Salazar ..... 16/222
4,858,274 A * 8/1989 Harrison et al. ..... 16/265
4,860,424 A * 8/1989 Kaibuki et al. ..... 16/262
4,881,298 A * 11/1989 Turnbull ..... 16/266
5,570,498 A * 11/1996 Hipkiss et al. ..... 16/258
5,706,556 A * 1/1998 Kluting ..... 16/273
5,867,870 A * 2/1999 Kluting ..... 16/254
5,924,170 A * 7/1999 Papke et al. ..... 16/321
6,332,243 B1 * 12/2001 Kim ..... 16/334

FOREIGN PATENT DOCUMENTS

DE 3401253 A1 * 1/1984

* cited by examiner

*Primary Examiner*—Chuck Y. Mah
(74) *Attorney, Agent, or Firm*—Kramer & Amado, P.C.

(57) ABSTRACT

An automotive hinge adapted to facilitate removable attachment of a closure panel to a body structure comprises a door component comprising upper and lower door component pivot arms adapted to be mounted to a vehicular closure panel, a body component comprising upper and lower body component pivot doors adapted to be mounted to a vehicular body structure, a common pivot axis around which the door component and body component are adapted to rotate in relation to each other, and a cylindrical protrusion adapted to be coaxially aligned with the pivot axis and structurally attached to and extended above the upper pivot arm of the body component, such that the door component is adapted to interleave over the body component, dimensionally locating the closure panel and the body structure by means of an external cylindrical bearing surface on the cylindrical protrusion, and is adapted to be held in assembly by means of a pivot pin which is adapted to extend through both said pivot arms of both said hinge components to create a fully structural, double hung pivot joint.

41 Claims, 3 Drawing Sheets

AUTOMOTIVE DOOR HINGE WITH REMOVABLE COMPONENT ADAPTED FOR STRUCTURAL REASSEMBLY

FIELD OF THE INVENTION

This invention applies to hinges, more particularly to automotive door hinges, which facilitate motion of a closure panel relative to a fixed body structure, and simplify removal and reinstallation of the closure panel to and from the body structure during specific phases of the vehicle assembly operation.

BACKGROUND TO THE INVENTION AND PRIOR ART

Automotive door hinges are generally configured to include a door component that is rigidly attached to a closure panel and a body component that is rigidly attached to a body structure. This structural attachment of the components can be achieved by welding, riveting, bolting or similar mechanical fastening means. The simple rotary motion of the door component relative to the body component is normally achieved by a pivot pin and associated bearing surfaces. The pivot pin is configured to be rigidly attached to one of the hinge components while the other component freely rotates around the pivot pin via one or more bearing surfaces. It is normal practice to utilize two of these hinge assemblies, vertically offset with coaxially aligned pivot pins, to attach a closure panel to a body structure.

In many modem automotive vehicle assembly plants, the closure panel is removed from the body structure after the vehicle has been initially assembled and painted. This post-painting detachment of the closure panel is undertaken to facilitate ease of final assembly of the vehicle interior which includes installing large components such as the instrument panel, seats, carpet and headliner as well as simplifying the final assembly of the door hardware components such as the latch and window lift mechanism. An important aspect of the closure panel's removal and reinstallation process is that it is normal practice to set the final door position during the vehicle's initial assembly, prior to painting. In this way the gap margins and surface flushness, which are among the most important aspects of vehicle quality, are set during the initial structural framing and can be evaluated before and just after painting. This generally accepted approach requires that the method utilized to remove and reinstall the closure panel after painting, during the final assembly process, must facilitate exact replication of the original door position. There is a wide range of prior art that facilitates the removal and reinstallation of vehicle closure panels while maintaining the dimensional integrity of the original installation process.

One embodiment utilizes welding or bonding to permanently locate the hinge components' floating, primary structural fasteners, which initially facilitated the adjustment of the closure panel relative to the body structure, subsequent to the acceptance of dimensional integrity. The closure panel can then be removed and reinstalled using the main hinge components' primary structural fasteners with the entire hinge assembly either staying with the closure panel or the body structure. This methodology does not facilitate welding, riveting or bonding of either the door component to the closure panel or the body component to the body structure. Additionally, it requires that the paint integrity on the closure panel or the body structure be violated during removal of the closure panel.

A second prior art embodiment utilizes a two piece construction for either the door component or the body component of the hinge. This methodology allows the removal of the door from the vehicle without utilizing the primary structural fasteners. Either a two-piece door component or a two-piece body component is separated after painting the vehicle by removing one or more secondary threaded fasteners. It is common to utilize an aspect or portion of the additional component to fit over an extension of the hinge pin to help facilitate the reinstallation by providing a feature to temporarily hold the closure panel in approximate position before fitting the secondary threaded fasteners. This three-piece arrangement adds significant cost and complexity in comparison to a conventional two-element hinge configuration; also, the capability to dimensionally replicate the initial assembly location, during reinstallation of the closure panel, is somewhat limited.

A third prior art embodiment utilizes a cantilevered pivot pin which facilitates the door component being simply interleaved over the body component of the hinge. The door component incorporates a suitably sized pivot bushing that interacts with the vertical, body component-mounted, cantilevered pivot pin to assure that the positional tolerance of the assembled door and body components is closely held. A clip, nut or similar mechanical device retains the door component on the pivot pin and a horizontal bearing surface between the two components transfers the vertical loadings. This cantilevered pivot pin arrangement is referred to as single hung; it transmits all imparted bending moments directly to the pivot pin. This is in contrast to a double hung arrangement that utilizes a simply supported pivot pin that passes through two supports of the grounded hinge component and transfers all bending moment loadings in double shear as linear force couples. The single hung, interleaved door and body component hinge facilitates dimensionally accurate reinstallation of the closure panel but is structurally inferior to a double hung configuration.

GENERAL DESCRIPTION OF THE INVENTION

Accordingly, it would be advantageous to create a hinge assembly in which the door component and body component can be simply separated after the closure panel has been properly fitted and structurally attached to the vehicle. Additionally, it would be a significant improvement over the existing art if the separation technique facilitated exact dimensional replication of the initial assembly location during reattachment of the two components while creating a fully structural, double hung pivot joint.

Accordingly, in an aspect of the invention, an automotive hinge adapted to facilitate removable attachment of a closure panel to a body structure comprises: a door component comprising upper and lower door component pivot arms adapted to be mounted to a vehicular closure panel; a body component comprising upper and lower body component pivot arms adapted to be mounted to a vehicular body structure; a common pivot axis around which the door component and body component are adapted to rotate; a cylindrical protrusion adapted to be coaxially aligned with the pivot axis and structurally attached to and extended above the upper pivot arm of the body component; such that the door component is adapted to interleave over the body component, dimensionally locating the closure panel and the body structure by means of an external cylindrical bearing surface on the cylindrical protrusion, and is adapted to be held in assembly by means of a pivot pin which is adapted to extend through both pivot arms of both hinge components to create a fully structural, double hung pivot joint.

In further aspects of the invention:

(a) the door component comprises an upper pivot bushing configured to fit tightly over the external cylindrical bearing surface of the cylindrical protrusion such that the positional tolerance of the assembled door and body components is closely held during reattachment of the closure panel after post-painting removal of the closure panel;

(b) the cylindrical protrusion comprises an internally threaded portion which interacts with an externally threaded portion of the pivot pin to provide a positive retention means for the pivot pin;

(c) the cylindrical protrusion comprises a machined component retained in the pivot arm of the body component by means of welding, bonding, material upsetting or similar mechanical fastening means;

(d) the cylindrical protrusion is formed out of the material of the pivot arm of the body component;

(e) the cylindrical protrusion comprises a smooth internal bore adapted to interact with a physical external feature on the pivot pin to provide a positive retention means for the pivot pin once it has been finally seated during reinstallation of the closure panel;

(f) the physical external feature on the pivot pin is a knurl, spline or other similar interface feature;

(g) the external cylindrical bearing surface on the cylindrical protrusion comprises a slight taper parallel to the pivot axis, to aid in lowering the separation forces required to separate the hinge components.

DETAILED DESCRIPTION OF THE INVENTION

Figure 1:
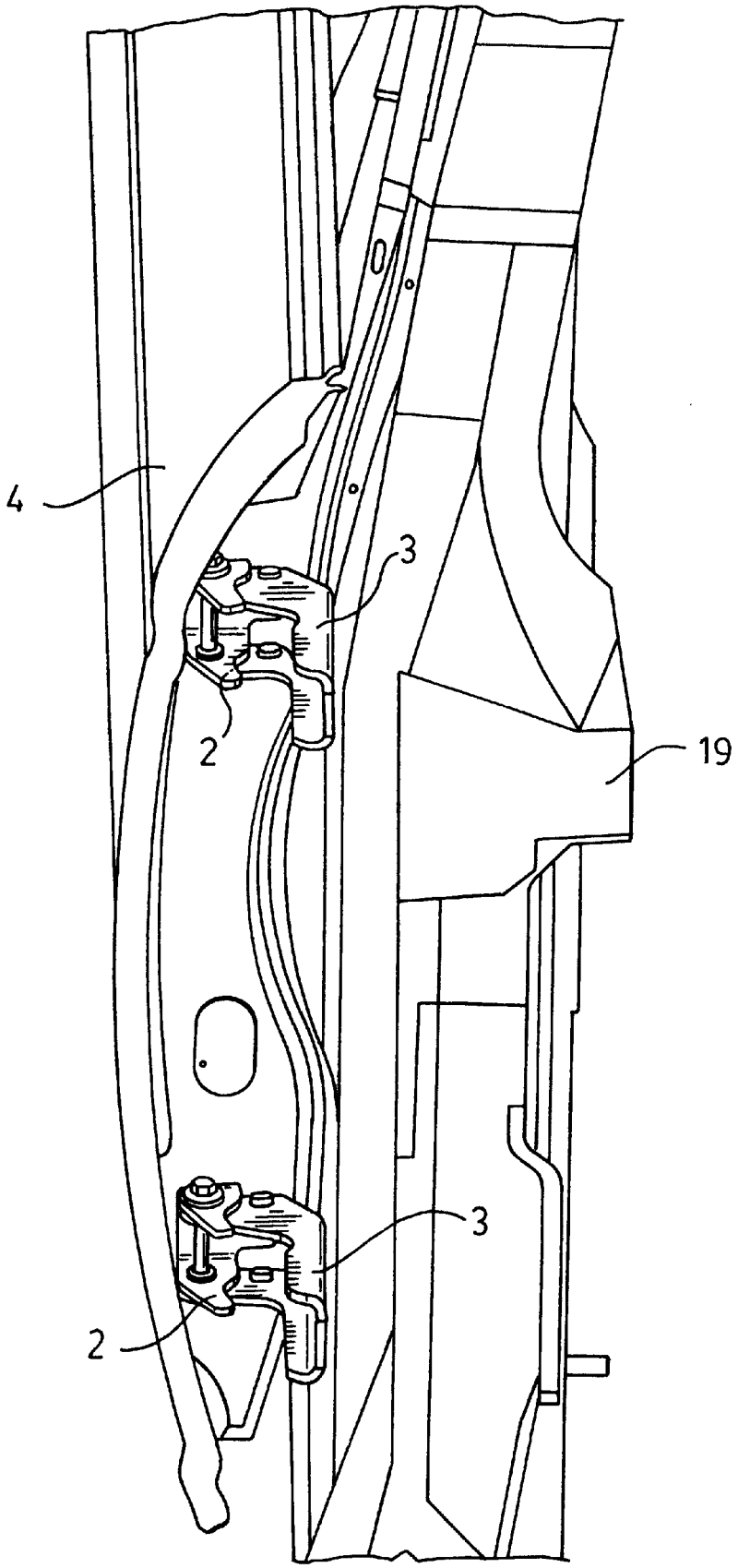
FIG. 1 is a perspective view of a pair of the inventive hinge assemblies in a typical automotive installation.
Figure 2:
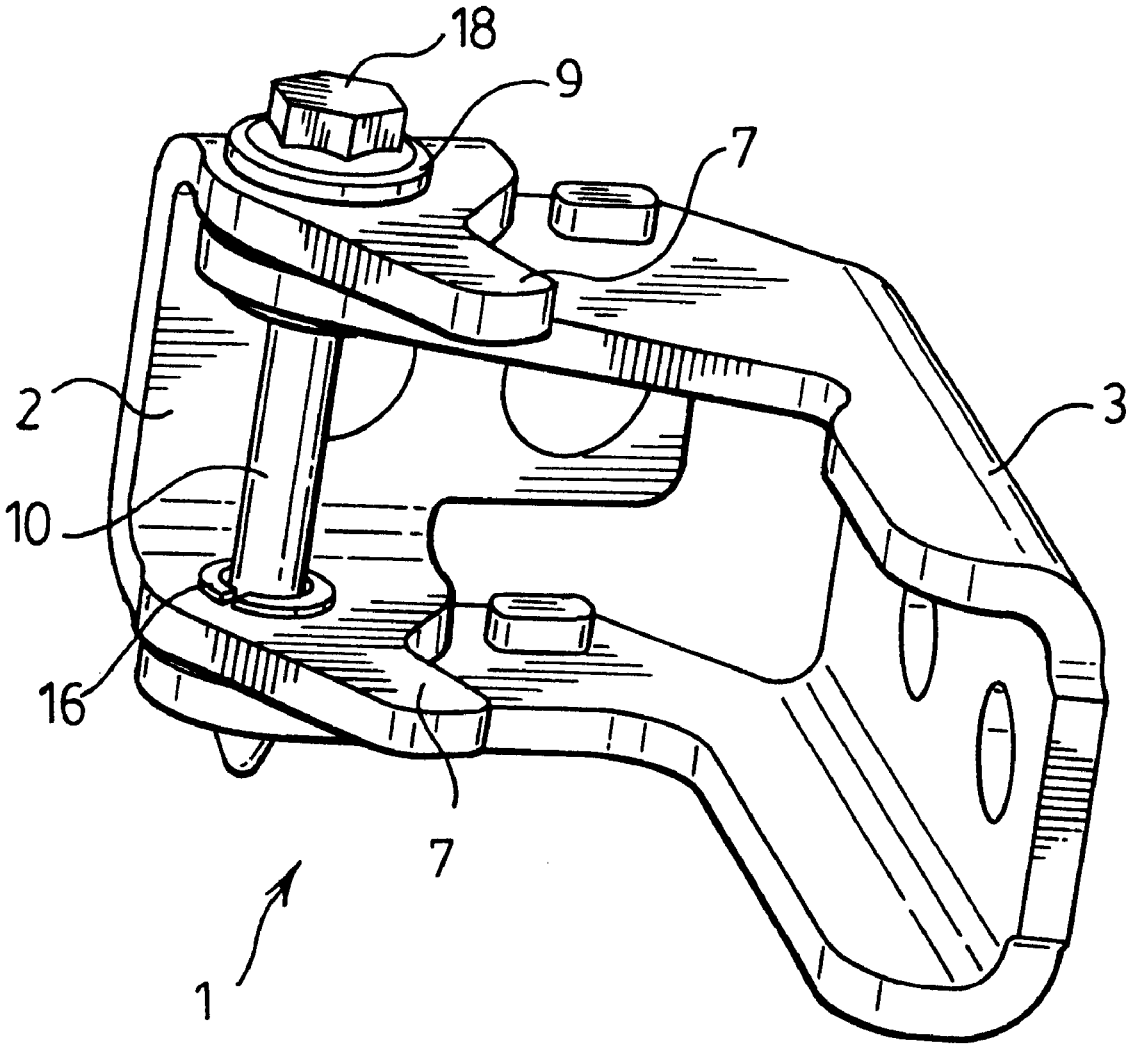
FIG. 2 is a perspective view of the inventive hinge assembly in a fully assembled state.
Figure 3:
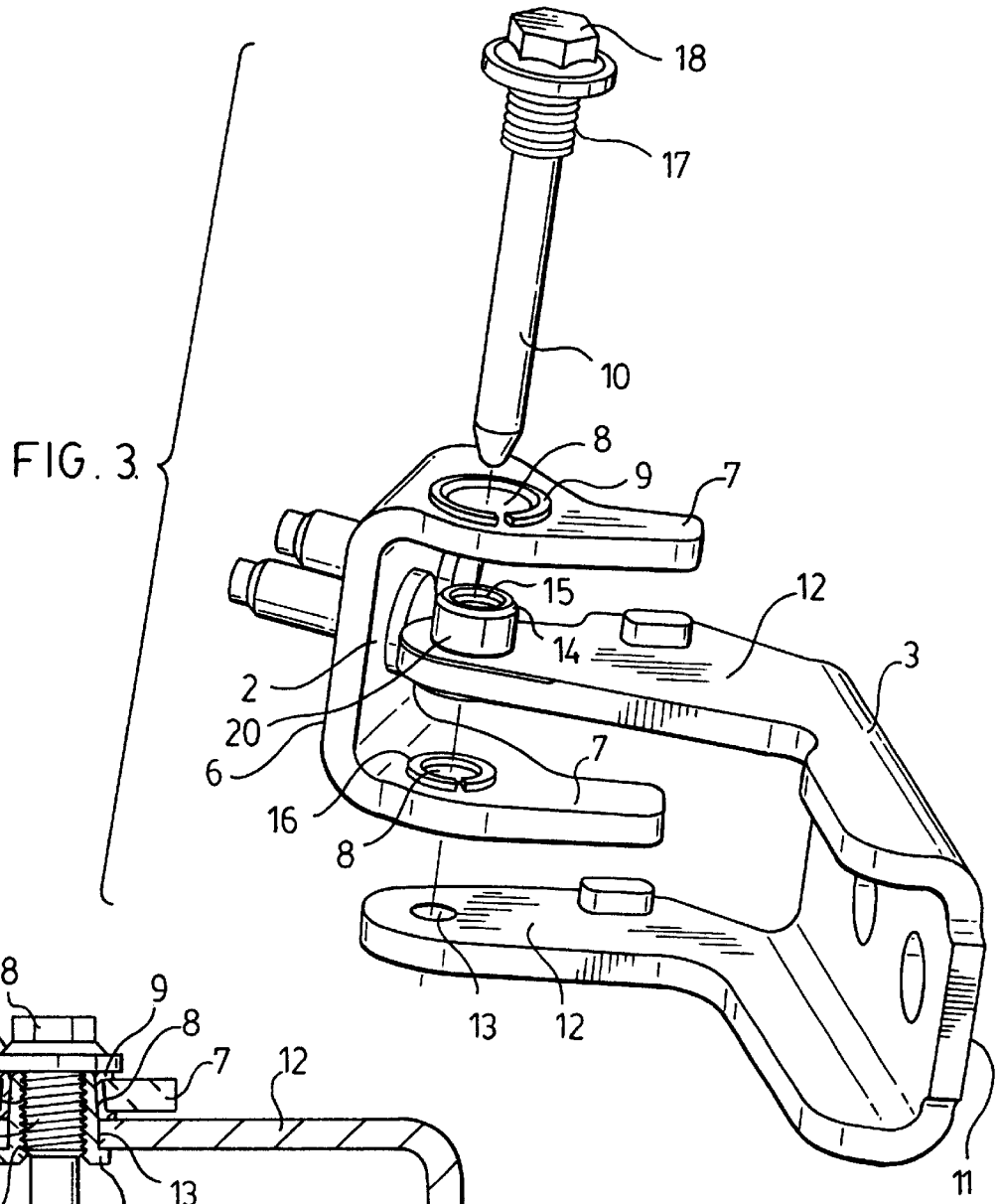
FIG. 3 is an exploded perspective view of the components of the inventive hinge assembly.

Referring to FIGS. 1, 2 and 3, a door hinge assembly (1) is substantially constructed from a door component (2) and a body component (3). The door component is configured with a mounting surface (6) and two pivot arms (7). Each pivot arm contains a pivot axis orifice (8). Into these orifices are fitted bushings (9, 16) which create bearing surfaces for the pivot pin (10). The door component is structurally attached to a closure panel (4) via its mounting surface (6) using bolting, welding, bonding, riveting or similar fastening means. The body component (3) is configured with a mounting surface (11) and two pivot arms (12). Each pivot arm comprises a pivot axis orifice (13). The upper pivot axis orifice contains a cylindrical protrusion (14) that extends above the pivot arm and is rigidly attached to the pivot arm using welding, bonding or some form of material upset. The cylindrical protrusion (14) is configured to provide an external cylindrical bearing surface (20) that remains coaxial with the pivot pin axis orifice as well as providing an internally threaded aspect (15) that is also coaxial with the pivot pin axis orifice. The body component (3) is structurally attached to a body structure (19) via the mounting surface (11) of the body component, using bolting, welding, bonding, riveting or similar fastening means.

The door component (2) interleaves over the body component (3) and dimensionally locates by reason of the external cylindrical bearing surface (20) of the cylindrical protrusion (14) mating to the inside diameter of the suitably sized upper pivot bushing (9). The assembly is structurally completed by the pivot pin (10) which bridges both hinge components through all of the pivot orifices. The pivot pin (10) is retained by an externally threaded aspect or portion (17) which interacts with the internally threaded aspect (15) of the cylindrical protrusion. Relative rotation of the two hinge components about the pivot pin (10) is facilitated by the upper pivot bushing (9) and lower pivot bushing (16). These bushings are rigidly integrated into the door component and freely rotate around the pivot pin which is rigidly attached to the body component via the threaded interface.

Structural loadings, such as those imparted by a crash, are transferred between the hinge component and body component via a double hung arrangement. The double hung hinge allows all bending moment loadings to be transferred in double shear as linear force couples. This significantly reduces the imparted stresses on the pivot pin in comparison to a cantilevered, single hung arrangement. Once the pivot pin has been finally assembled to the hinge by applying a suitable torque to the hexagonal head (18) or similar tool interface, the system returns identical structural performance to a fully riveted, double hung hinge arrangement.

Figure 4:
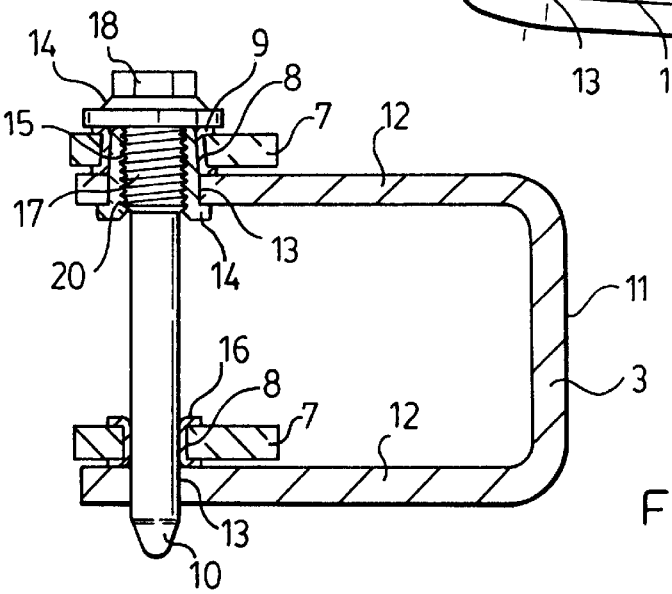
FIG. 4 is a sectional view of the inventive hinge assembly through the centreline of the pivot pin.

The post-painting removal of the closure panel is facilitated by simply unthreading the pivot pins and removing them from the upper and lower hinge assemblies. The closure panel can then be lifted so that the door components' upper pivot bushings (9) clear the cylindrical protrusions (14) and free the closure panel to be removed from the vehicle. When the closure panel is reinstalled on the vehicle, the upper and lower hinges' door components are aligned with the body components by placing the upper pivot bushings (9) over the cylindrical protrusions (14) in a similar manner to the cantilevered pivot pin prior art embodiment, described above. The pivot pins (10) are then inserted through the hinges until the externally threaded aspects (17) of the pivot pins engage with the internally threaded aspects (15) of the cylindrical protrusions (14). The assemblies are then structurally completed by applying a suitable torque to the hexagonal head (18) or similar tool interface. The completed hinge is shown in FIG. 4. In this way the hinge offers the simplicity of removal and reinstallation of the cantilevered pivot pin prior art embodiment, but eliminates the associated structural shortcomings.

What is claimed is:

1. An automotive hinge adapted to facilitate removable attachment of a closure panel to a body structure, comprising:

(a) a door component comprising upper and lower door component pivot arms adapted to be mounted to a vehicular closure panel;

(b) a body component comprising upper and lower body component pivot arms adapted to be mounted to a vehicular body structure;

(c) a common pivot axis around which the door component and body component are adapted to rotate in relation to each other;

(d) a cylindrical protrusion adapted to be coaxially aligned with the pivot axis and structurally attached to and extended above the upper pivot arm of the body component;

such that the door component is adapted to interleave over the body component, dimensionally locating the closure panel and the body structure by means of an external cylindrical bearing surface on the cylindrical protrusion, and is adapted to be held in assembly by means of a pivot pin which is adapted to extend through both said pivot arms of both said hinge components to create a fully structural, double hung pivot joint.

2. The automotive hinge of claim 1, wherein the door component comprises an upper pivot bushing configured to fit tightly over the external cylindrical bearing surface of the cylindrical protrusion such that the positional tolerance of the assembled door and body components is closely held during reattachment of the closure panel after post-painting removal of the closure panel.

3. The automotive hinge of claim 2, wherein the cylindrical protrusion comprises an internally threaded portion which interacts with an externally threaded portion of the pivot pin to provide a positive retention means for the pivot pin.

4. The automotive hinge of claim 3, wherein the cylindrical protrusion comprises a machined component retained in the pivot arm of the body component by means of welding, bonding, material upsetting, or similar mechanical fastening means.

5. The automotive hinge of claim 4, wherein the cylindrical protrusion comprises a smooth internal bore adapted to interact with a physical external feature on the pivot pin to provide a positive retention means for the pivot pin once it has been finally seated during reinstallation of the closure panel.

6. The automotive hinge of claim 5, wherein the physical external feature on the pivot pin is a knurl, spline or other similar interface feature.

7. The automotive hinge of claim 3, wherein the cylindrical protrusion is formed out of the material of the pivot arm of the body component.

8. The automotive hinge of claim 7, wherein the cylindrical protrusion comprises a smooth internal bore adapted to interact with a physical external feature on the pivot pin to provide a positive retention means for the pivot pin once it has been finally seated during reinstallation of the closure panel.

9. The automotive hinge of claim 8, wherein the physical external feature on the pivot pin is a knurl, spline or other similar interface feature.

10. The automotive hinge of claim 3, wherein the external cylindrical bearing surface on the cylindrical protrusion comprises a slight taper, parallel to the pivot axis, to aid in lowering the separation forces required to separate the hinge components.

11. The automotive hinge of claim 2, wherein the cylindrical protrusion comprises a machined component retained in the pivot arm of the body component by means of welding, bonding, material upsetting, or similar mechanical fastening means.

12. The automotive hinge of claim 11, wherein the cylindrical protrusion comprises a smooth internal bore adapted to interact with a physical external feature on the pivot pin to provide a positive retention means for the pivot pin once it has been finally seated during reinstallation of the closure panel.

13. The automotive hinge of claim 12, wherein the physical external feature on the pivot pin is a knurl, spline or other similar interface feature.

14. The automotive hinge of claim 11, wherein the external cylindrical bearing surface on the cylindrical protrusion comprises a slight taper, parallel to the pivot axis, to aid in lowering the separation forces required to separate the hinge components.

15. The automotive hinge of claim 2, wherein the cylindrical protrusion is formed out of the material of the pivot arm of the body component.

16. The automotive hinge of claim 15, wherein the cylindrical protrusion comprises a smooth internal bore adapted to interact with a physical external feature on the pivot pin to provide a positive retention means for the pivot pin once it has been finally seated during reinstallation of the closure panel.

17. The automotive hinge of claim 16, wherein the physical external feature on the pivot pin is a knurl, spline or other similar interface feature.

18. The automotive hinge of claim 2, wherein the cylindrical protrusion comprises a smooth internal bore adapted to interact with a physical external feature on the pivot pin to provide a positive retention means for the pivot pin once it has been finally seated during reinstallation of the closure panel.

19. The automotive hinge of claim 18, wherein the physical external feature on the pivot pin is a knurl, spline or other similar interface feature.

20. The automotive hinge of claim 2, wherein the external cylindrical bearing surface on the cylindrical protrusion comprises a slight taper, parallel to the pivot axis, to aid in lowering the separation forces required to separate the hinge components.

21. The automotive hinge of claim 1, wherein the cylindrical protrusion comprises an internally threaded portion which interacts with an externally threaded portion of the pivot pin to provide a positive retention means for the pivot pin.

22. The automotive hinge of claim 21, wherein the cylindrical protrusion comprises a machined component retained in the pivot arm of the body component by means of welding, bonding, material upsetting, or similar mechanical fastening means.

23. The automotive hinge of claim 22, wherein the cylindrical protrusion comprises a smooth internal bore adapted to interact with a physical external feature on the pivot pin to provide a positive retention means for the pivot pin once it has been finally seated during reinstallation of the closure panel.

24. The automotive hinge of claim 23, wherein the physical external feature on the pivot pin is a knurl, spline or other similar interface feature.

25. The automotive hinge of claim 21, wherein the cylindrical protrusion is formed out of the material of the pivot arm of the body component.

26. The automotive hinge of claim 25, wherein the cylindrical protrusion comprises a smooth internal bore adapted to interact with a physical external feature on the pivot pin to provide a positive retention means for the pivot pin once it has been finally seated during reinstallation of the closure panel.

27. The automotive hinge of claim 26, wherein the physical external feature on the pivot pin is a knurl, spline or other similar interface feature.

28. The automotive hinge of claim 21, wherein the external cylindrical bearing surface on the cylindrical protrusion comprises a slight taper, parallel to the pivot axis, to aid in lowering the separation forces required to separate the hinge components.

29. The automotive hinge of claim 1, wherein the cylindrical protrusion comprises a machined component retained in the pivot arm of the body component by means of welding, bonding, material upsetting, or similar mechanical fastening means.

30. The automotive hinge of claim 29, wherein the cylindrical protrusion comprises a smooth internal bore adapted to interact with a physical external feature on the pivot pin to provide a positive retention means for the pivot pin once it has been finally seated during reinstallation of the closure panel.

31. The automotive hinge of claim 30, wherein the physical external feature on the pivot pin is a knurl, spline or other similar interface feature.

32. The automotive hinge of claim 29, wherein the external cylindrical bearing surface on the cylindrical protrusion comprises a slight taper, parallel to the pivot axis, to aid in lowering the separation forces required to separate the hinge components.

33. The automotive hinge of claim 1, wherein the cylindrical protrusion is formed out of the material of the pivot arm of the body component.

34. The automotive hinge of claim 33, wherein the cylindrical protrusion comprises a smooth internal bore adapted to interact with a physical external feature on the pivot pin to provide a positive retention means for the pivot pin once it has been finally seated during reinstallation of the closure panel.

35. The automotive hinge of claim 34, wherein the physical external feature on the pivot pin is a knurl, spline or other similar interface feature.

36. The automotive hinge of claim 33, wherein the external cylindrical bearing surface on the cylindrical protrusion comprises a slight taper, parallel to the pivot axis, to aid in lowering the separation forces required to separate the hinge components.

37. The automotive hinge of claim 1, wherein the cylindrical protrusion comprises a smooth internal bore adapted to interact with a physical external feature on the pivot pin to provide a positive retention means for the pivot pin once it has been finally seated during reinstallation of the closure panel.

38. The automotive hinge of claim 37, wherein the physical external feature on the pivot pin is a knurl, spline or other similar interface feature.

39. The automotive hinge of claim 38, wherein the external cylindrical bearing surface on the cylindrical protrusion comprises a slight taper, parallel to the pivot axis, to aid in lowering the separation forces required to separate the hinge components.

40. The automotive hinge of claim 37, wherein the external cylindrical bearing surface on the cylindrical protrusion comprises a slight taper, parallel to the pivot axis, to aid in lowering the separation forces required to separate the hinge components.

41. The automotive hinge of claim 1, wherein the external cylindrical bearing surface on the cylindrical protrusion comprises a slight taper, parallel to the pivot axis, to aid in lowering the separation forces required to separate the hinge components.

* * * * *